US005791951A

United States Patent [19]

Staerzl

[11] Patent Number: 5,791,951

[45] Date of Patent: Aug. 11, 1998

[54] CLUTCH CONTROLLER FOR A TWIN PROPELLER MARINE PROPULSION UNIT

[75] Inventor: Richard E. Staerzl, Fond du Lac, Wis.

[73] Assignee: Brunswick Corporation, Lake Forest, Ill.

[21] Appl. No.: 799,710

[22] Filed: Feb. 13, 1997

[51] Int. Cl.[6] ..... B63H 20/14

[52] U.S. Cl. ..... 440/75; 440/86

[58] Field of Search ..... 440/80, 81, 75, 440/86

[56] References Cited

U.S. PATENT DOCUMENTS

| | | | |
|---|---|---|---|
| 2,672,115 | 3/1954 | Conover . | |
| 2,989,022 | 6/1961 | Lundquist . | |
| 3,478,620 | 11/1969 | Shimanckas . | |
| 4,793,773 | 12/1988 | Kinouchi et al. . | |
| 5,030,149 | 7/1991 | Fujita | 440/81 |
| 5,230,644 | 7/1993 | Meisenburg et al. . | |
| 5,249,995 | 10/1993 | Meisenburg et al. . | |
| 5,352,141 | 10/1994 | Shields et al. . | |
| 5,366,398 | 11/1994 | Meisenburg et al. . | |
| 5,376,031 | 12/1994 | Meisenburg et al. . | |
| 5,403,218 | 4/1995 | Onoue et al. . | |
| 5,449,306 | 9/1995 | Nakayasu et al. . | |
| 5,514,014 | 5/1996 | Ogino et al. . | |
| 5,520,559 | 5/1996 | Nakgayasu et al. . | |
| 5,522,703 | 6/1996 | Okamoto . | |
| 5,529,520 | 6/1996 | Iwashita et al. . | |
| 5,599,215 | 2/1997 | Jarvinen | 440/81 |

FOREIGN PATENT DOCUMENTS

| | | | |
|---|---|---|---|
| 93698 | 4/1988 | Japan | 440/80 |

*Primary Examiner*—Stephen Avila

*Attorney, Agent, or Firm*—Andrus, Sceales Starke & Sawall

[57] ABSTRACT

A clutch controller and method for selectively engaging and disengaging one of the propellers in a twin propeller marine propulsion unit for a watercraft. The clutch controller is connected to a solenoid controlled valve to selectively engage and disengage one of a pair of counter-rotating propellers. The clutch controller includes a frequency-to-voltage converter which converts the engine speed to a voltage. The voltage based on the engine speed is compared to an upper limit such that the propeller is disengaged until the engine speed reaches the upper limit. Once the engine speed exceeds the specified upper limit, the second propeller is engaged. The clutch controller maintains engagement of the second propeller until the engine speed drops below a second intermediate limit. After falling below this intermediate limit, the second propeller is again disengaged. The clutch controller unit further includes a wiper offset circuit which allows the propeller to be initially engaged at a lower engine speed when the boat is being operated at wide open throttle positions. A bypass circuit compares the engine speed to a lower voltage such that the second propeller is engaged until the engine speed exceeds the lower limit, which is below idle engine speed.

18 Claims, 6 Drawing Sheets

FIG. 3
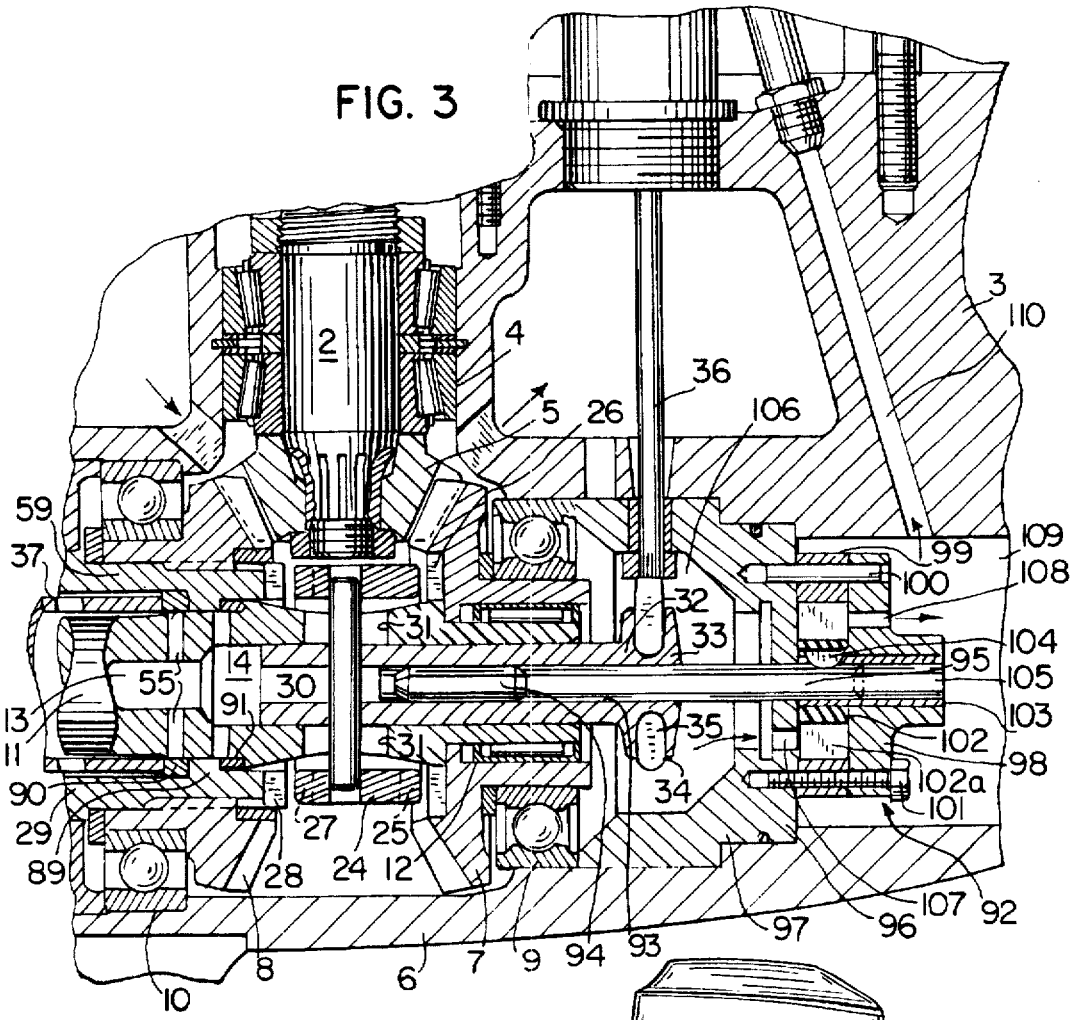
FIG. 1
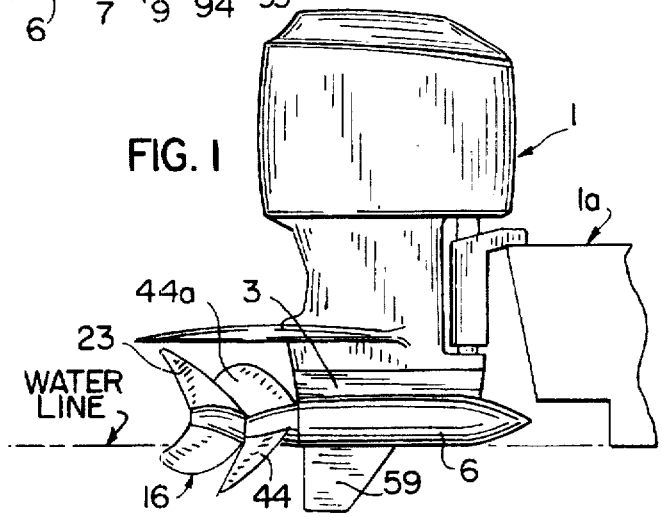
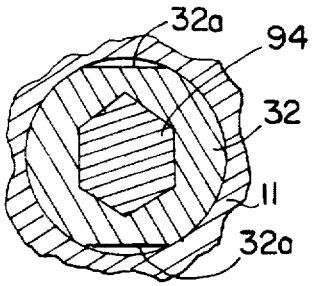
FIG.8

CLUTCH CONTROLLER FOR A TWIN PROPELLER MARINE PROPULSION UNIT

BACKGROUND OF THE INVENTION

Some marine propulsion units, such as outboard drives and inboard/outboard or stern drives, utilize a forward-neutral-reverse transmission, along with twin counter-rotating propellers. The typical twin propeller system includes a vertical drive shaft which is operably connected to the engine and is journaled for rotation in the lower gear case. The lower end of the drive shaft carries a pinion which drives a pair of coaxial gears that are located in the lower torpedo-shaped section of the gear case. Inner and outer propeller shafts are mounted concentrically in the lower section of the gear case. Each propeller shaft carries a separate propeller, and the propeller of the outer shaft is located forward of the propeller of the inner shaft.

U.S. Pat. No. 4,793,773 describes a twin propeller propulsion system utilizing a sliding clutch mechanism having forward, neutral and reverse positions. When the clutch is moved in one direction to provide forward movement of the watercraft, the clutch acts to operably connect one of the bevel gears with the inner propeller shaft to thereby rotate the rear propeller and simultaneously connect the second bevel gear with the outer propeller shaft to rotate the outer propeller shaft and the front propeller in the opposite direction. Thus, during forward movement of the watercraft, both propellers are rotated at the same speed but in opposite directions.

While a twin propeller propulsion system is very effective at high speed boat operations, the increased mass of the second propeller reduces the initial acceleration as compared to a motor having only a single propeller. In a twin propeller propulsion system incorporating surfacing propellers, only one blade of each propeller is in the water at any time when the boat is on plane. During initial start-up, however, the load on the engine is greatly increased since the surfacing propeller is completely submerged and all of the propeller blades must be driven through the water. Thus, during initial start-up, the increased load on the engine results in decreased acceleration in getting up to plane. Therefore, it can be appreciated that a marine propulsion system in which only a single propeller is operated during initial start-up to increase acceleration and a pair of propellers are operated after the engine reaches a desired speed would be an improvement in marine propulsion systems having twin propellers.

SUMMARY OF THE INVENTION

The invention is directed to an improved twin propeller marine propulsion unit, such as an outboard drive or a stern drive, in which, in a forward mode of operation, only one of the propellers is driven a low engine speed, and the second propeller is driven when the engine speed reaches a preselected elevated value. More particularly, the invention is directed to a clutch controller which actives a clutch assembly to selectively engage and disengage the second propeller based on engine speed.

The clutch controller of the invention includes a frequency-to-voltage converter. The frequency-to-voltage converter is connected to the ignition trigger of the marine propulsion system and receives a series of pulses from the ignition trigger. The pulses from the ignition trigger are generated at a frequency directly corresponding to the engine speed, such that as the engine speed increase, the frequency of the pulses from the ignition trigger also increases.

The frequency-to-voltage converter converts the pulses from the ignition trigger into an engine speed voltage. The engine speed voltage is compared to a first reference voltage which corresponds to an upper engine speed limit such that when the engine speed voltage exceeds the first reference voltage, an engage signal is generated that causes the second propeller of the dual propeller system to be engaged. Thus, the second propeller is engaged when the engine speed exceeds the upper engine speed limit.

After the second propeller has been engaged, the first reference voltage is reduced to a second reference voltage corresponding to an intermediate engine speed limit. Since the second reference voltage is less than the initial first reference voltage, the second propeller will remain engaged until the engine speed voltage falls below the reduced second reference voltage. Thus, the second propeller initially becomes engaged when the engine speed exceeds an upper limit and does not become disengaged until the engine speed drops below the reduced, intermediate limit.

In another feature of the invention, the clutch controller includes a throttle offset circuit. The throttle offset circuit is directly connected to the engine throttle wiper, such that when the engine throttle wiper is wide open, an offset voltage is added to the engine speed voltage. Thus, the combination of the offset voltage and the engine speed voltage exceeds the first reference voltage at a lower engine speed, causing the second propeller to become engaged at a lower engine speed during wide open engine operation.

In another feature of the invention, the clutch controller compares the engine speed voltage to a third reference voltage. The clutch controller causes the second propeller to be engaged until the engine speed exceeds a lower engine speed limit below idle represented by the third reference voltage. Once the engine speed exceeds the lower engine speed limit, the clutch controller causes the second propeller to become disengaged. The clutch controller thus causes the propeller to be engaged should power be disrupted to the clutch controller.

In the construction of a marine propulsion unit incorporating the clutch controller of the invention, only a single propeller is operable at low speeds. Thus, during initial acceleration to get on plane, less blade area is in driving contact with the water which reduces the load on the engine. Once the preselected upper engine speed limit has been exceeded, the second propeller is then driven, resulting in significant improvement in acceleration of the watercraft when getting on plane.

Other objects and advantages of the invention will appear in the course of the following description.

BRIEF DESCRIPTION OF THE DRAWINGS

The drawings illustrate the best mode presently contemplated of carrying out the invention.

In the drawings:

FIG. 1 is a side elevation view of an outboard marine drive incorporating the clutch controller of the invention;

FIG. 3 is an enlarged fragmentary longitudinal section of a portion of the lower drive unit;

FIG. 8 is an enlarged transverse section showing the oil passage in the sleeve that is mounted in the inner propeller shaft;

DETAILED DESCRIPTION OF THE ILLUSTRATED EMBODIMENT

The present invention is an electronic clutch controller which acts to selectively engage and disengage one of the propellers in a twin propeller marine propulsion system. The electronic clutch controller of the invention operates to engage the second propeller only after the engine speed reaches an upper limit. After the second propeller has been engaged, the electronic clutch controller allows the second propeller to remain engaged even after the engine speed drops below the initial engagement speed. The electronic clutch controller of the invention can be utilized with an inboard/outboard stern drive, or other marine drive system. In the preferred embodiment of the invention, the electronic clutch controller of the invention is used on a marine outboard engine as shown in FIGS. 1–8, which are taken from commonly owned co-pending U.S. application Ser. No. 08/719,633, filed Sep. 25, 1996. The marine outboard engine 1, shown in FIG. 1, will be described in detail below, which description is taken from said application Ser. No. 08/719,633, in order to facilitate complete understanding of the operation of the clutch controller, which is the subject of the present invention.

FIGS. 1–8

Figure 2:
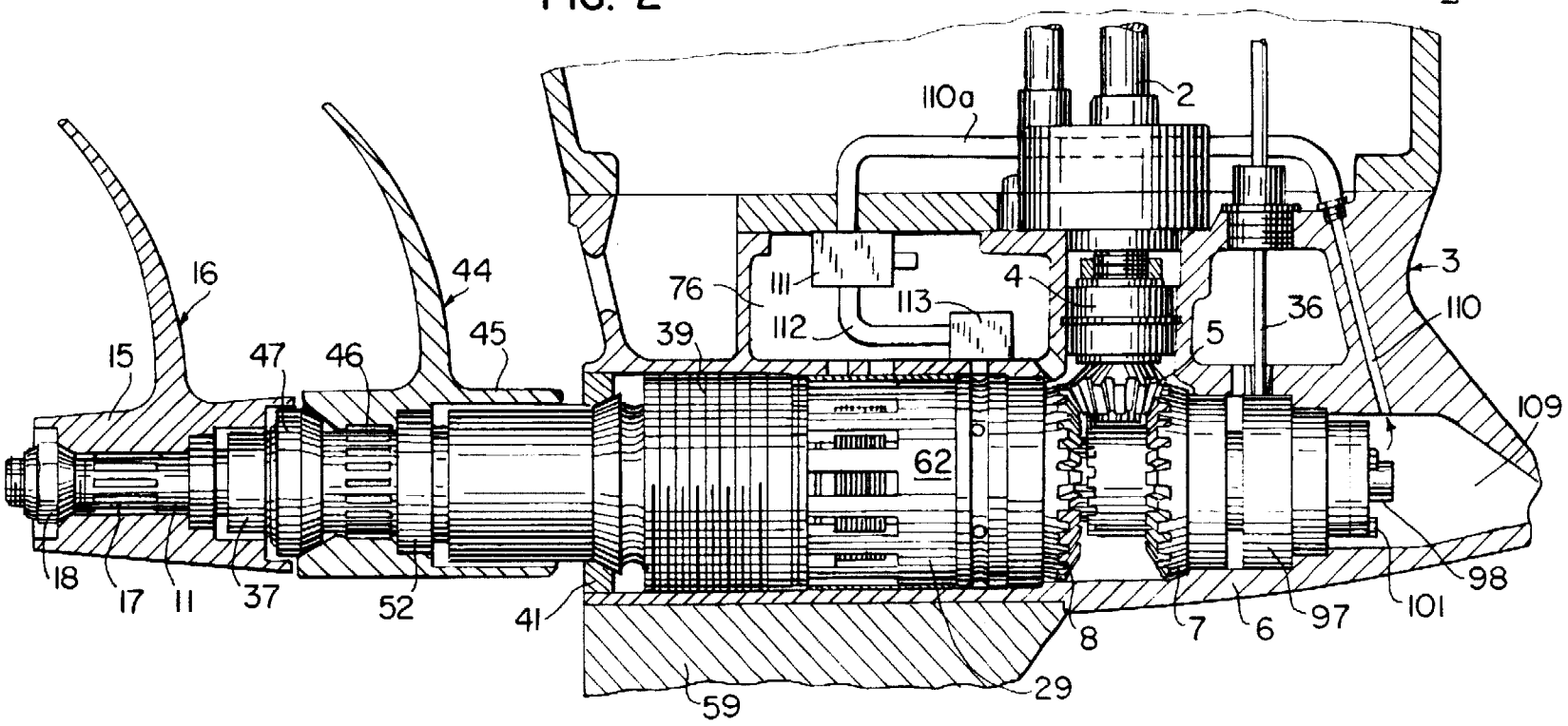
FIG. 2 is a longitudinal section of the lower drive unit.

As best shown in FIGS. 2 and 3, outboard engine 1 includes a vertical drive shaft 2 which is journaled for rotation in gear case 3 by a bearing assembly 4. The lower end of drive shaft 2 carries a beveled pinion gear 5 that is located within the lower torpedo-shaped section 6 of the gearcase.

Pinion gear 5 drives a pair of coaxial annular bevel gears 7 and 8. As best shown in FIG. 3, the hub portion of bevel gear 7 is journaled within torpedo section 6 by a bearing assembly 9, while the hub portion of bevel gear 8 is journaled within torpedo section 6 by bearing assembly 10. An inner propeller shaft 11 extends through the aligned openings in bevel gears 7 and 8, and the forward end of shaft 11 is journaled within the hub of bevel gear 7 by needle bearing assembly 12. The central portion of inner propeller shaft 11 is provided with an axial passage 13 which merges into an enlarged forward passage 14.

Figure 5:
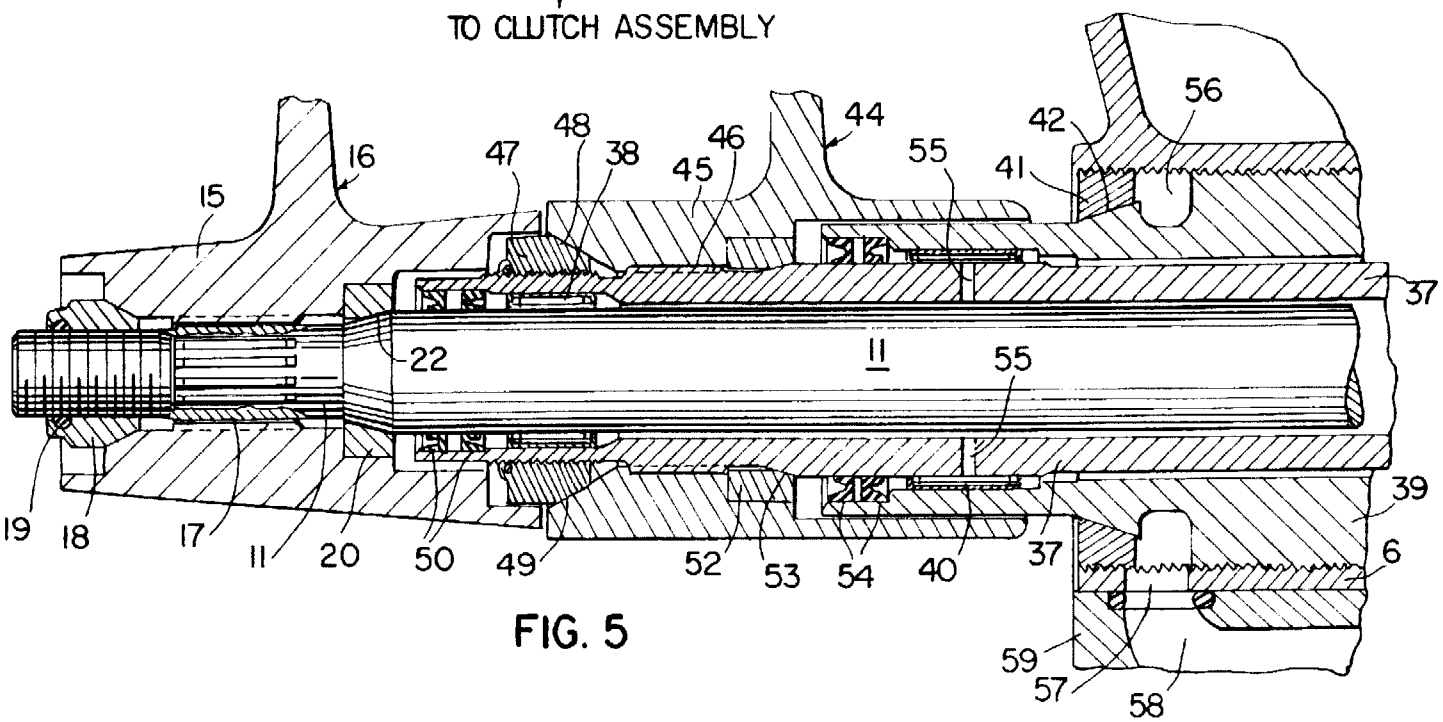
FIG. 5 is an enlarged fragmentary longitudinal section showing the attachment of the twin propellers to the propeller shafts.

The hub 15 of a propeller 16 is secured to the rear end of inner propeller shaft 11 through a spline 17. To retain propeller 16 on the end of shaft 11, a stop nut 18 is threaded on the end of the shaft and has a beveled inner surface which engages a corresponding beveled surface on the end of shaft 11, as seen in FIG. 5.

A thrust ring 20, preferably formed of a metal such as bronze, is press-fitted within a circumferential groove in hub 15, and is provided with a tapered inner surface that engages the tapered outer surface 22 of shaft 11. By press-fitting thrust ring 20 to hub 15, the ring will not accidentally be dislodged from the hub during replacement of the propeller 16.

As best shown in FIG. 1, propeller 16 includes a plurality of blades 23 which are located at a rearward rake angle of about 20° to 30°, and preferably about 25°.

An annular sliding clutch 24 is located within the torpedo section 6 and includes a series of forwardly facing teeth 25 which are adapted to engage teeth 26 on bevel gear 7. Clutch 24 is also formed with a series of rearwardly facing teeth 27, which are adapted to engage teeth 28 that are positioned on the forward end of cup-shaped housing 29 that is splined to the hub portion of bevel gear 8 and rotates with the bevel gear. Clutch 24 is adapted to be moved between three positions, namely a central or neutral position, a forward position where teeth 25 engage teeth 26 on bevel gear 7, and a rearward position in which the teeth 27 engage teeth 28 on housing 29.

To move the clutch between the three positions, a pin 30 extends diametrically across clutch 24 and extends through elongated slots 31 formed in the inner propeller shaft 11. Pin 30 also extends through a pair of aligned holes in a sleeve 32 that is mounted in the forward passage 14 of the inner propeller shaft 11. As best seen in FIG. 3, the forward end 33 of sleeve 32 is enlarged and is provided with a circumferential groove 34 that receives a crank 35 mounted on the lower end of actuating rod 36. Rotation of rod 36 will pivot crank 35 to thereby move sleeve 32 axially and thus move clutch 24 between the neutral, forward and rear positions. When clutch 24 is moved forwardly to engage teeth 25 with teeth 26 on bevel gear 7, the clutch will rotate with bevel gear 7 and impart rotation to the inner propeller shaft 11 to drive propeller 16.

An outer propeller shaft 37 is mounted concentrically around the inner propeller shaft 11 and the rear end portion of shaft 37 is journaled for rotation on inner shaft 11 by a bearing assembly 38.

To provide support for propeller shafts 11 and 37, an annular bearing carrier 39 is threaded within the rear end of torpedo section 6 and is positioned between the outer propeller shaft 37 and the torpedo section 6, as best shown in FIG. 5. Bearing assembly 40 is located between carrier 39 and outer propeller shaft 37, and serves to journal the shaft for rotation. A ring 41 is threaded in the rear end of torpedo section 6 and is provided with a tapered inner surface 42 that engages the tapered outer surface on carrier 39. By threading down the ring 41, the rear portion of the carrier 39 will be urged radially inward to provide support for the bearing 40.

A second front propeller 44 is secured to the outer propeller shaft 37 and is located forwardly of propeller 16. Front propeller 44 includes a hub 45 that is connected to shaft 37 through spline 46. As in the case of propeller 16, propeller 44 includes a series of blades 44*a* each having a rearward rake of about 20° to 30°, and preferably about 25°. To retain propeller 44 on shaft 37, a stop nut 47 is threaded on the end of shaft 37 and is provided with a tapered surface 48 which engages a similarly tapered surface 49 on hub 45. In practice, forward propeller 44 can be a left hand screw, while rear propeller 16 can be a right hand screw.

A pair of annular seals 50 are located to the rear of bearing assembly 38 and serve to seal the space between shafts 11 and 37.

A ring 52 formed of bronze or the like, is press fitted in an internal circumferential recess in hub 45, and is provided with an internal tapered surface 53 which engages a similarly tapered surface on shaft 37. Ring 52 is located forwardly of spline 46, as best shown in FIG. 5. In addition, a pair of annular seals 54 are positioned in a recess in the end of carrier 39 and seal the space between the carrier and the outer propeller shaft 37.

Lubricating oil is adapted to fill the internal passages 13 and 14 of inner propeller shaft 11. Shaft 11 is provided with a series of radial holes 55 and the two forward groups of holes 55 are aligned with radial holes in the outer propeller shaft 37 so that lubricating oil can be delivered to bearing assemblies 38 and 40.

The annular space 56, best seen in FIG. 5, located forwardly of ring 41 constitutes a cooling water passage that communicates with an opening 57 in the lower portion of torpedo section 6. Opening 57, in turn, is in sealed communication with a water passage 58 in skeg 59. Cooling water drawn through an inlet in skeg 59 flows through passage 58 into passage 56 and then flows through internal passages in gearcase 3, not shown, to the water pump, which is driven by drive shaft 2. The water inlet arrangement in skeg 59 can be similar to that described in commonly owned co-pending U.S. application Ser. No. 08/718,917, filed Sep. 25, 1996.

As previously noted, housing 29 includes a plurality of forwardly facing teeth 28 which are adapted to engage teeth 27 on clutch 24 when the clutch is moved rearwardly. The hub portion 60 of housing 29 is splined to bevel gear 8, as seen in FIG. 3, and rotates with the bevel gear. Housing 29 also includes an enlarged rear portion 62 that houses a multiple disc clutch 63. Clutch assembly 63, when engaged, functions to connect the housing 29 with outer propeller shaft 37 to thereby drive propeller 44.

Figure 4:
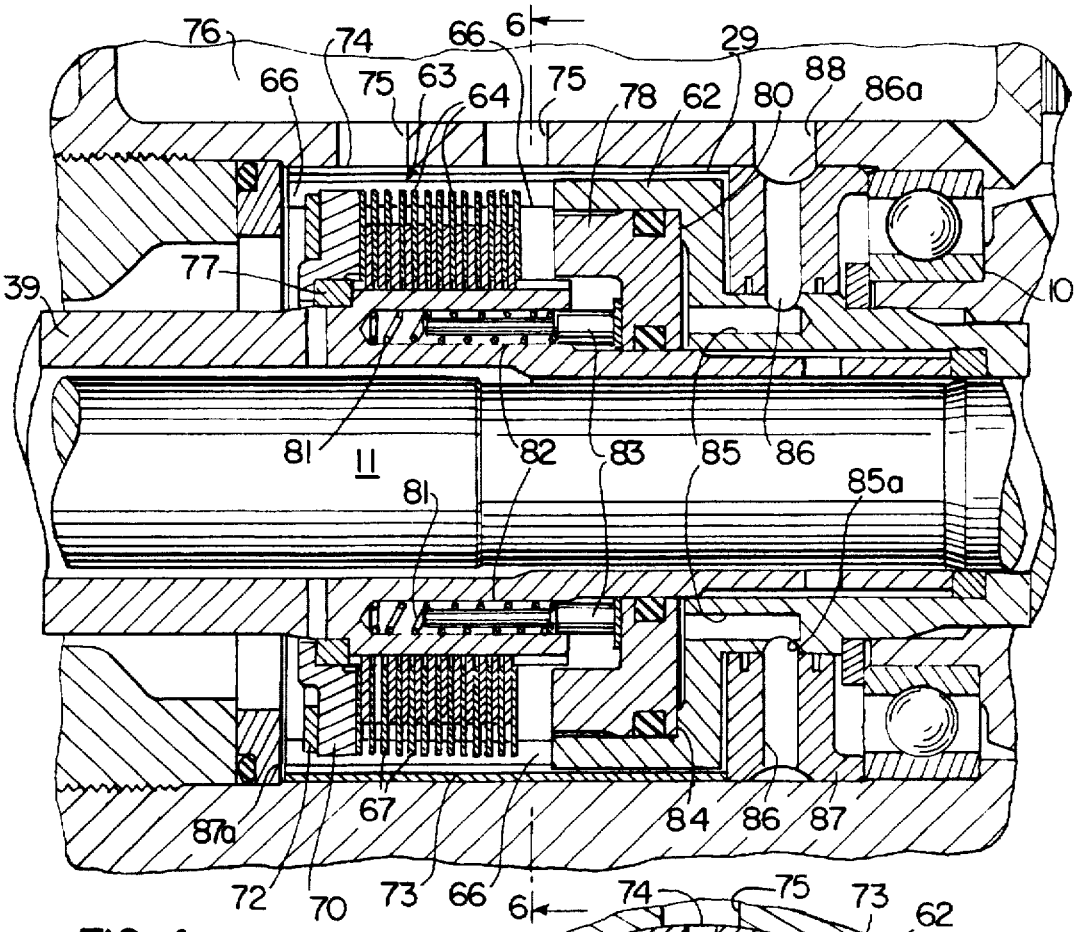
FIG. 4 is an enlarged fragmentary longitudinal section of a second portion of the drive unit showing the multiple disc clutch mechanism.
Figure 6:
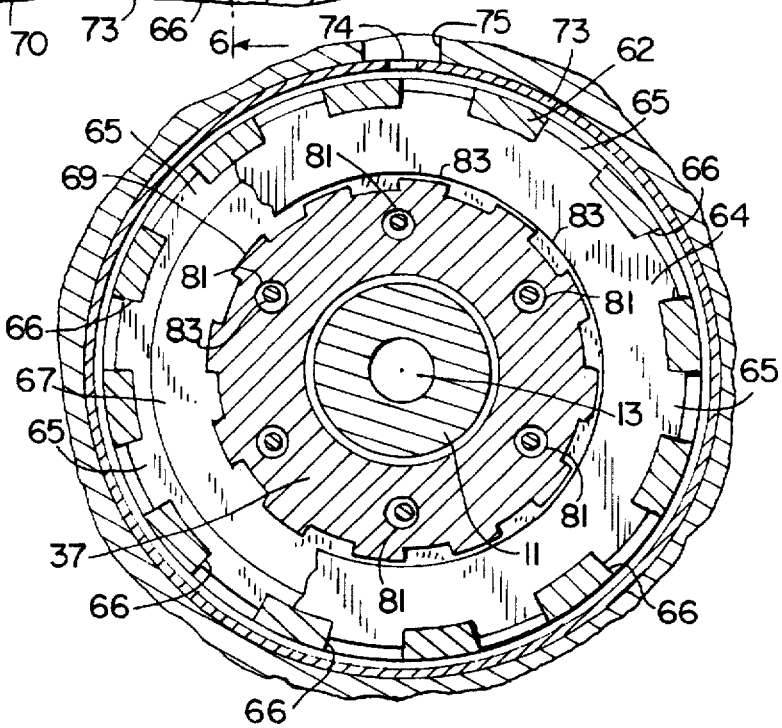
FIG. 6 is a section taken along line 6–6 of FIG. 4.

Clutch assembly 63, as best shown in FIGS. 4 and 6, includes a series of clutch discs 64 each having a plurality of circumferentially spaced, outwardly extending ears or lugs 65, which are engaged with slots 66 formed in the enlarged rear portion 62 of housing 29. A second group of generally flat clutch discs 67 are interdigitated with discs 64 and opposite faces of the discs 67 are provided with a friction coating. Discs 67 are connected to the outer propeller shaft 37 through spline 69.

Discs 64 and 67 are contained within the enlarged rear portion 62 of housing 29 by an annular cap 70, having circumferentially spaced peripheral ears or lugs that engage the slot 66 in housing portion 62. The cap is retained in position by a snap ring 72.

Spaced outwardly of section 62 of housing 29 is a cylindrical metal sleeve 73 having a longitudinal slot 74 which registers with holes 75 in gearcase 3. Holes 75 communicate with an oil sump or reservoir 76 formed in the gearcase, as illustrated in FIG. 4. Oil can flow between reservoir 76 and torpedo section 6 through holes 75 and slot 74.

A thrust bearing 77 to take the reverse thrust of outer propeller shaft 37 is located to the rear of the clutch discs 64 and 67, and is mounted within an internal recess in cap 70.

Clutch discs 64 and 67 are moved into driving engagement by an annular piston 78 which is mounted in the enlarged section 62 of housing 29. Piston 78 has a rear face which is adapted to engage the discs 64 and 67, and is also provided with a forward face 80. Piston 78 is urged forwardly by a series of springs 81, as shown in FIG. 4, each of which is mounted within a longitudinal hole 82 in outer propeller shaft 37. The rear end of each spring 81 engages the bottom of hole 82 while the forward end of each spring bear against a shoulder on pin 83 which, in turn, bears against the piston 78. Thus, the force of springs 81 will urge the piston 78 forwardly. In this position, the peripheral edge of forward face 80 will engage a shoulder 84 on housing 29, as seen in FIG. 4, to space face 80 away from the bottom of housing 29.

Piston 78 is adapted to be moved rearwardly to engage clutch discs 64 and 67 by a hydraulic system carried by gearcase 3. In this regard, the rotating housing 29 is provided with a series of axial holes 85 which communicate with the space between piston face 80 and the bottom of housing 29. The forward ends of holes 85 connect with an annular groove **85*a* formed in the outer surface of hub portion 60 of housing 29, and groove 85*a* in turn communicates with radial holes 86 in ring 87. Ring 87 is fixed to gearcase 3 and is positioned between bearing assembly 9 and the forward end of sleeve 73. The outer ends of radial holes 86 communicate via a circumferential groove 86*a* with an opening 88 in gear case 3 which leads to control valve 113**.

Figure 7:
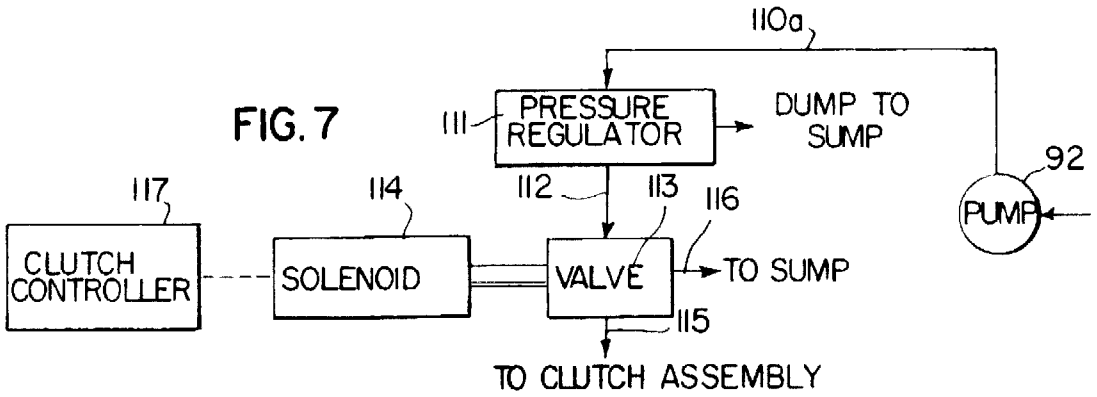
FIG. 7 is a schematic view showing the clutch controller and hydraulic system for operating the clutch.

With this construction, pressurized oil from control valve 113, FIG. 7, can be supplied through holes 86 and 85 to the housing 29 to thereby move piston 78 rearwardly and cause engagement of the disc clutch 63.

As illustrated in FIG. 3, the forward end of housing 29 is formed with a circumferential internal rib 89 and thrust bearings 90 and 91 located on either side of rib 89. Thrust bearing 90 is located between rib 89 and the forward end of the outer propeller shaft 37 and takes its forward thrust, while thrust bearing 91 is located forwardly of rib 89 and takes the rear thrust of inner propeller shaft 11.

As shown in FIG. 3, to pressurize the hydraulic fluid contained within the lower drive unit, a pump 92 is operably connected to inner propeller shaft 11. Sleeve 32 is provided with a central longitudinal opening 93 that has a hexagonal configuration, and the rear hexagonal-shaped end 94 of quill shaft 95 is received within the opening 93, so that rotation of sleeve 32 will be transmitted to quill shaft 95.

Pump 92 is a conventional gear pump of generator type, including a generally flat rear wall 96 that is connected to a ring 97 having an opening to receive clutch rod 36. Pump 92 also includes a forward wall 98, and an eccentric spacer 99 is positioned between the rear wall 96 and the forward wall 98. The rear and forward walls 96 and 98, as well as spacer 99, are connected together by a plurality of dowels 100 along with a series of bolts 101. The space between the rear and forward walls 96 and 98 defines a pumping chamber, and a toothed inner rotor 102 and a toothed outer rotor **102*a* are mounted for rotation within the chamber. Inner rotor 102 is connected to the rear end of a sleeve 103 by a key 104, and the sleeve, in turn, is provided with an internal, hexagonal configuration which is engaged with the hexagonal section 105 of quill shaft 95. With this construction, rotation of clutch 24 and inner propeller shaft 11 will rotate sleeve 32 and quill shaft 95 to thereby drive pump 92**.

The chamber 106 located at the forward portion of the torpedo section 6 of the gearcase is normally filled with oil and during operation of pump 92 oil will be drawn from chamber 106 through inlet 107 to the pump, and pressurized fluid will be discharged from the pump through outlet 108 to the forward chamber 109. The pressurized fluid will then flow through passage 110 and line **110*a* to pressure regulator 111**.

The clutch driver mechanism for supplying pressurized hydraulic fluid or oil to the multiple disc clutch 63 is shown schematically in FIG. 7. Line **110*a* containing the pressurized fluid from pump 92 is connected to a conventional pressure regulator 111 which, in practice, would discharge fluid at a pressure of about 200 psi through line 112 to a two-position valve 113 operated by solenoid 114. Valve 113 of the clutch driver has one outlet line 115 connected to opening 88 of clutch assembly 63 and a second outlet line 116 connected to reservoir 76**.

As shown in FIG. 8, sleeve 32 has a pair of diametrically opposed flats **32*a* that define oil passages for the flow of oil through inner shaft 11 from chamber 106**.

It has been found that with a V-bottom boat, the least drag from the boat hull is achieved at a running angle of about 2½° to 4½° depending on the dead rise angle of the V-bottom. However, in practice, it has been noted that these running angles are not normally obtainable because the boat will begin to "porpoise" at lower running angles. Thus, "porpoising" of the boat occurs at less than the best running angle.

Studies and testing have shown that when considering a propeller alone, without interaction with a boat or watercraft, a 0° propeller rake is most efficient. However, when the propeller is interacted with a boat, a rearward rake of about 15° to 20° has been found to be most beneficial for all-around performance, and a higher rake, above 20°, has been found to be less efficient. Through the invention, it has been found that utilizing a higher rake of above 20°, and preferably about 25°, with full surfacing counter-rotating propellers in which the water line is below the torpedo section, produces certain unexpected advantages. More specifically, the high rearward rake will act to dampen "porpoising" of the boat at high speeds, to thereby permit running at a more favorable running angle, to reduce boat drag. Secondly, the high rake produces a downward component of force on the propeller blades which aids in lifting the bow of the boat to reduce drag.

FIGS. 9 AND 10

The solenoid 114 of the clutch driver mechanism, FIG. 7, is selectively energized by a clutch controller 117 that senses the engine speed and is shown in detail in FIG. 9 and further described below. When solenoid 114 is energized, valve 113 supplies pressurized fluid to second outlet 116 to disengage second propeller 44. At low speeds, clutch assembly 63 will not be engaged. When the engine speed increases to an elevated pre-selected upper limit, the clutch controller 1 17 will de-energize solenoid 114 and pressurized hydraulic fluid entering the valve 113 through line 112 will be directed through outlet line 115, causing engagement of clutch assembly 63 to drive the outer shaft 37 and second propeller 44. In this manner, should the clutch controller 117 fail, the solenoid 114 will be de-energized, causing engagement of the second propeller 44.

The operation of the clutch controller 117 in selectively engaging and disengaging the second, front propeller 44 through the clutch driver mechanism will now be discussed in detail with particular reference being made to FIGS. 9 and 10. As previously stated, when the solenoid 114 is de-energized, the second propeller 44 is engaged by the clutch assembly 63. When the solenoid 114 is energized, the clutch assembly 63 disengages the second propeller 44 such that only rear propeller 16 will operate.

Figure 10:
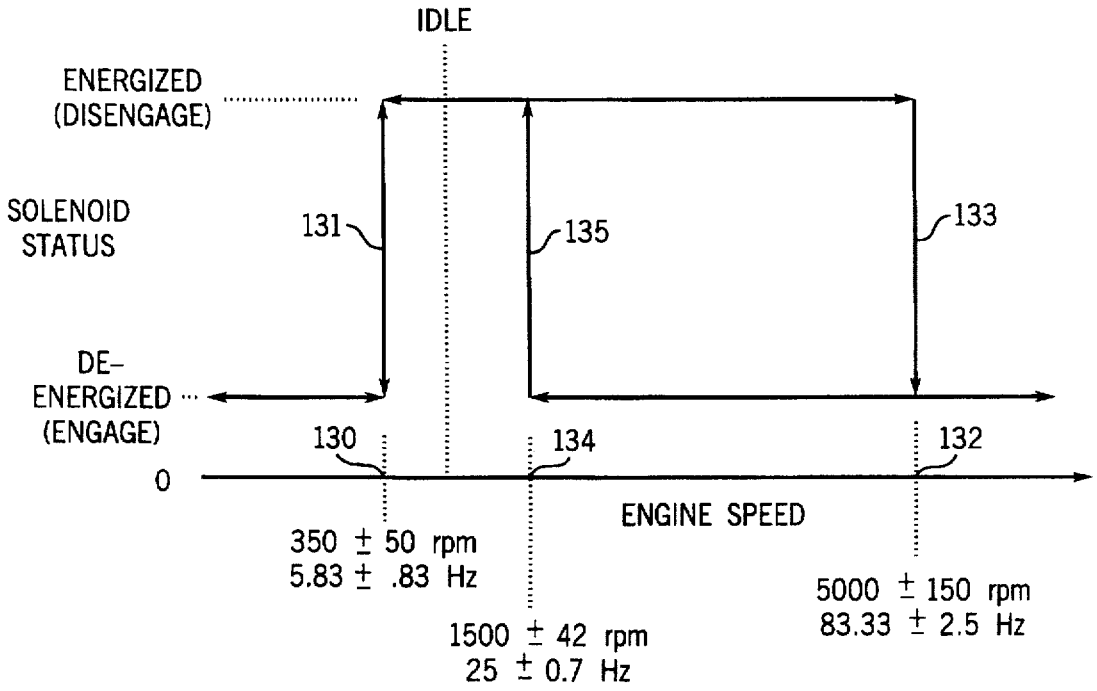
FIG. 10 is a diagram showing the operation of the clutch assembly based on engine speed.

The preferred engine speed operating parameters for the solenoid 114 are shown in FIG. 10. As the diagram indicates, the solenoid 114 is de-energized and propeller 44 engaged at engine speeds below a lower limit 130, such as approximately 350 RPM in the preferred embodiment. As shown, the lower limit 130 is below the idle speed of the engine such that the second propeller 44 is disengaged when the engine is idling. It is desirable that the solenoid 114 remain de-energized below idle speeds to prevent current drain through the solenoid 114 if the ignition key switch is left "on" and the engine is not running. Additionally, having the solenoid 114 de-energized, and hence second propeller 44 engaged, when the engine speed is below the lower limit 130 acts as a fail safe feature as will be discussed in detail below.

Once the engine speed reaches the lower limit 130, the solenoid 114 is energized as indicated by arrow 131, causing valve 113 to divert the pressurized fluid through line 116 and hence disengage clutch assembly 63 and second propeller 44. After the engine speed exceeds the lower limit 130, the solenoid remains energized until the engine speed reaches an upper limit 132. In the preferred embodiment of the invention, the upper limit 132 is approximately 5,000 RPM. Upon reaching the upper limit 132, the solenoid 114 is de-energized as indicated by arrow 133, causing valve 113 to divert the pressurized fluid through line 115 to the clutch assembly 63, such that second propeller 44 is engaged.

Following de-energization of solenoid 114 (arrow 133), solenoid 114 will remain de-energized and the second propeller 44 engaged until the engine speed drops below an intermediate limit 134 which is well below the upper limit 132. In the preferred embodiment of the invention, the intermediate limit 134 is approximately 1500 RPM. The difference in engine speed between the upper limit 132 and the intermediate limit 134 prevents the second propeller 44 from disengaging during high operating engine speeds, which could cause steering torque and a change in boat operating characteristics.

Once the engine speed falls below the intermediate limit 134, the solenoid 114 is again energized as indicated by arrow 135. After being energized (arrow 135), the solenoid 114 will not again become de-energized until the engine speed exceeds the upper limit 133 or drops below lower limit 131. Since the second propeller 44 is engaged when the solenoid 144 is de-energized, any system failure which results in power being disrupted to solenoid 114 results in the second propeller 44 being engaged, which is a desirable feature.

Figure 9:
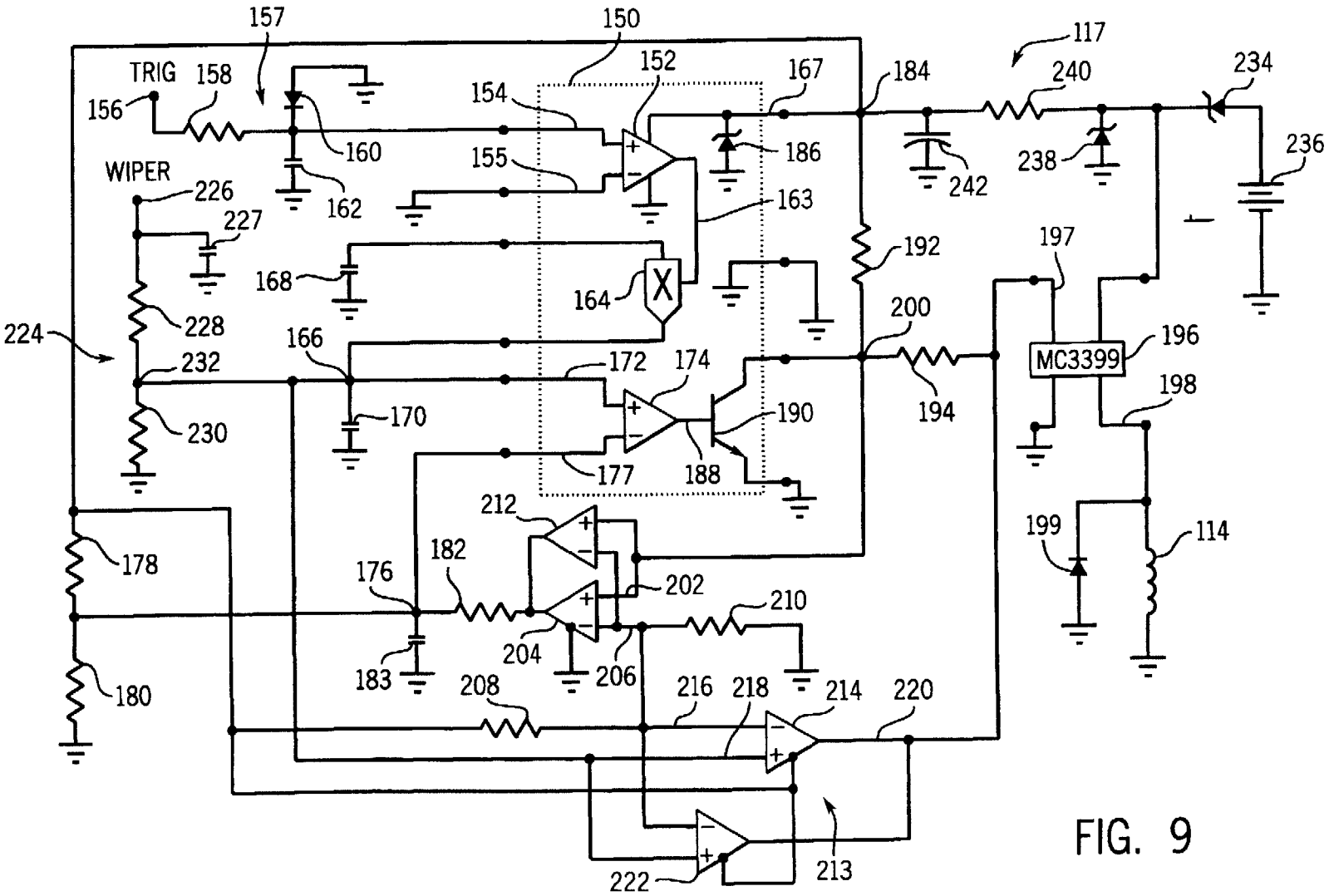
FIG. 9 is a detailed circuit diagram for the clutch controller in accordance with the invention.

The clutch controller 117 is shown in FIG. 9 and will now be discussed in detail. The clutch controller 117 is centered around a commonly available frequency-to-voltage converter 150. In the preferred embodiment of the invention, the frequency-to-voltage converter 150 is Model No. LM2917N sold by National Semiconductor. The factory configured internal components and pin connections of the frequency-to-voltage converter 150 are shown to facilitate understanding of the operation of the frequency-to-voltage converter 150. The converter 150 includes a first internal comparator 152. The non-inverting terminal 154 of the comparator 152 is connected to the ignition trigger 156 for the marine engine through an input conditioning circuit 157 including resistor 158, diode 160, and capacitor 162. The input conditioning circuit 157 conditions the series of pulses from the ignition trigger 156 such that the comparator 152 can more easily receive and process the signal. The ignition trigger 156 is a common internal combustion engine component that generates a series of pulses which are used to fire the engine spark plugs. Therefore, the frequency of the pulses from the ignition trigger 156 is directly related to the RPM speed of the engine. FIG. 10 shows the frequency of the ignition trigger 156 as related to the RPM speed of the engine for the lower limit 130, upper limit 132 and intermediate limit 134 for the preferred embodiment of the invention.

Since the inverting terminal 155 of the comparator 152 is tied to ground, the output 163 of the comparator 152 goes high at the same frequencies as the pulse from the ignition trigger 156 present at the non-inverting terminal 154. The output 163 of internal comparator 152 is fed to an internal charge pump 164. Internal charge pump 164 is a standard component in the frequency-to-voltage converter 150 and internal charge pump 164 outputs a voltage to node 166 which is directly related to the frequency of the input from the ignition trigger 156. The relationship between the voltage output to node 166 and the frequency of the input at terminal 154 is governed by a standard relationship detailed by the component manufacturer of the frequency-to-voltage converter 150. For the LM2917N of the preferred embodiment, the voltage output to node 166 is the product of the frequency of the input at terminal 154, the supply voltage at pin 167, the capacitance of capacitor 168 and the resistance seen by node 166. Thus, the voltage at node 166 is directly proportional to the frequency of the pulses at the non-inverting terminal 154 of internal comparator 152.

The voltage at node 166 charges capacitor 170 to an engine speed voltage that is directed related to the frequency of the pulses from ignition trigger 156 as previously discussed. Thus, as the engine speed increases, the engine speed voltage across capacitor 170 increases. Node 166 is connected to the non-inverting terminal 172 of a second internal comparator 174. A first reference voltage from node 176 is connected to the inverting terminal 177 of the internal comparator 174. The first reference voltage at node 176 is set by a voltage divider provided by resistor 178 and resistor 180. During initial engine operation, resistor 182 is effectively removed from the circuit as will be discussed in detail below. A capacitor 183 is connected between node 176 and ground. Resistor 178 of the voltage divider is connected to node 184, which is regulated by an internal zener diode 186 to approximately 7.5 volts.

The internal comparator 174 will output a low value at output 188 until the engine speed voltage at node 166 connected to the non-inverting terminal 172 exceeds the reference voltage at the inverting terminal 177. The output 188 of comparator 174 is directly connected to the base of transistor 190. When the output 188 of comparator 174 is low, transistor 190 remains "off", since the voltage at the base of transistor 190 is insufficient to turn the transistor 190 "on". When transistor 190 is "off", a positive voltage is fed from node 184 through resistors 192 and 194 to solenoid driver 196. Solenoid driver 196 is a conventional component, such as Model No. MC3399 sold by Motorola. When the solenoid driver 196 receives a high signal at input 197, the solenoid driver 196 energizes the solenoid 114 through output line 198. The solenoid driver 196, solenoid 114 and valve 116 combine to form the clutch driver which selectively engages and disengages the second propeller 44. As previously discussed, when the solenoid 114 is energized, the second propeller 44 is disengaged. Diode 199 is connected across solenoid 114 to provide a path for current when solenoid 114 is discharged.

While the transistor 190 is "off", the high voltage value at node 200 is also applied to the non-inverting terminal 202 of comparator 204. The inverting terminal 206 of comparator 204 receives a second reference voltage set by the voltage divider provided by resistors 208 and 210. The second reference voltage is selected to be low enough such that when the transistor 190 is "off", the voltage at the non-inverting terminal 202 of comparator 204 exceeds the voltage at the inverting terminal 206. Thus, when transistor 190 is "off", comparator 204 outputs its high limit. When the comparator 204 is high, the comparator 204 acts as an open circuit between node 176 and ground, effectively removing resistor 182 from the circuit.

As the engine speed increases, the frequency of the pulses at the ignition trigger 156 also increases, causing an increase in the engine speed voltage across capacitor 170. The increase in the engine speed voltage at capacitor 170 is directly related to the increase in frequency of the pulses at the ignition trigger 156. As the engine speed voltage across capacitor 170 increases, it approaches the first reference voltage at node 176. By selecting the values of resistors 178 and 180, the first reference voltage at node 176 can be set such that the engine speed voltage at node 166 will exceed the voltage at node 176 only when the engine RPM's reach a selected value corresponding to the upper limit 132 in FIG. 10.

When the engine speed voltage at node 166 exceeds the first reference voltage at node 176, the internal comparator 174 outputs a high signal at output 188 to the base of transistor 190. The high signal at the base of transistor 190 turns transistor 190 "on", thereby effectively grounding node 200 through transistor 190. Since node 200 is now grounded, the positive voltage is removed from input 197 to solenoid driver 196, thereby de-energizing solenoid 114 as shown by arrow 133. As previously discussed, when the solenoid 114 is de-energized, the second propeller 44 is engaged.

When transistor 190 is turned "on", the grounded node 200 also grounds the non-inverting terminal 202 of comparator 204. Since the voltage at the inverting terminal 206 will now exceed the voltage at the grounded non-inverting terminal 202, the comparator 204 goes low. When the comparator 204 is outputting the low limit, the comparator 204 provides a path to ground, thereby effectively inserting resistor 182 into the circuit. With resistor 182 inserted into the circuit, the reference voltage generated at node 176 is reduced from the first reference voltage, since value of the parallel combination of resistors 180 and 182 is less than the single resistor 180. The reduced voltage at node 176 corresponds to the intermediate limit 134 shown in FIG. 10. Since the reference voltage at node 176 has now decreased to the intermediate limit 134, the voltage at node 166, which is directly related to engine speed, can fall below the initial value (upper limit 132) needed to trigger comparator 174 before the transistor 190 is again turned "off", resulting in the energization of solenoid 114. Therefore, the comparator 202 and resistor 182 act as an engine speed limit modifying circuit by effectively switching in the resistor 182 after the engine speed exceeds the upper limit 132, such that the solenoid 114 will remain de-energized between the upper limit 132 and the intermediate limit 134, as shown in FIG. 10. By selecting the values of resistors 178,180 and 182, the values of the upper limit 132 and the intermediate limit 134 can be determined, thus causing the solenoid 114 to energize and de-energize based on desired engine speeds as previously described.

Comparator 212 performs the same function as comparator 204 and has its inputs and output tied to the inputs and output of comparator 204. The second comparator 212 acts a fail-safe for comparator 204, such that if comparator 204 malfunctions, comparator 212 will perform the function specified in regard to comparator 204.

A bypass circuit 213 is connected between the frequency-to-voltage converter 150 and solenoid driver 196 to set the lower limit 130 as will be discussed. The bypass circuit 213 includes a comparator 214 having its inverting terminal 216 tied to a reference voltage set by a voltage divider provided by the combination of resistor 208 and resistor 210. Non-inverting terminal 218 of comparator 214 is tied to node 166, which represents the voltage based on engine speed from the frequency-to-voltage converter 150. The comparator 214 thus outputs its low value at output 220 until the engine speed voltage at node 166 exceeds the reference voltage at the inverting input terminal 216. Since the output 220 is tied directly to the solenoid driver 196, the solenoid 114 will be de-energized when little or no voltage is present at node 166. Comparator 214 will output its high value at output 220 when the voltage at node 166 exceeds the reference voltage set by resistors 208 and 210. The high value of output 220 energizes the solenoid 114 to disengage the propeller 44. The combination of resistors 208 and 210 are selected to set the lower limit 130 in FIG. 10, such that the second propeller 44 is engaged until the engine speed exceeds the lower limit 130. Thus, if the ignition key is left "on" or if an error occurs in the clutch controller 117, the low value at output 220 will cause the solenoid 114 to be de-energized, thus engaging the second propeller 44.

The bypass circuit 213 includes a second comparator 222 that performs the same function as comparator 214 and has its inputs and outputs tied to the inputs and outputs of comparator 214. The second comparator 222 is included in clutch controller 117 as a fail-safe for comparator 214.

In the preferred embodiment of the invention, clutch controller 117 includes a throttle offset circuit 224. The throttle offset circuit 224 is connected to a throttle wiper 226 used in operation of the boat. Throttle wiper 226 is connected to a convention engine throttle and outputs an increasing voltage as the throttle is opened further. To increase engine performance during racing, it is desirable that the second propeller 44 is engaged at engine speeds slightly below the upper limit 132 when the engine throttle is in the wide open position. The throttle offset circuit 224 includes capacitor 227 and a voltage divider provided by resistors 228 and 230 which divide the voltage from the throttle wiper 226 accordingly. The voltage at node 232 increases the further throttle wiper 226 is depressed. The voltage at node 232 is added to the engine speed voltage at node 166, thereby elevating the voltage fed into the non-inverting terminal 172 of comparator 174 without an increase in engine speed. Thus, when the engine throttle is in the wide open position, an offset voltage from node 232 is added to the engine speed voltage at node 166, thereby causing the comparator 174 to output a high value and engage the second propeller 44 at an engine speed below the upper limit 132.

Clutch controller 117 includes a zener diode 234 which acts as a reverse battery protection for battery 236. Additionally, the clutch controller 117 includes zener diode 238 which acts as an over-voltage protection. Resistor 240 and capacitor 242 are connected between battery 236 and node 184 to condition the voltage from the battery 236.

OPERATION

FIG. 3 shows the clutch 24 in the neutral position. To move the watercraft or boat forwardly, clutch actuating rod 36 is rotated causing the crank 35 to move the sleeve 32 and clutch 24 forwardly, or to the right as shown in FIG. 3, to cause engagement of clutch teeth 25 with teeth 26 on bevel gear 7. This results in the rotation of bevel gear 7 being transmitted to the inner propeller shaft 11 to drive the propeller 16.

At idle speed, as well as low speeds below the pre-selected upper limit 132 of about 5000 RPM, pump 92 will operate to deliver the fluid to valve 113, but at this time solenoid 114 positions valve 113 in a first position, such that fluid will be merely dumped from the valve 113 to the sump or reservoir 76 through line 116 and will not be delivered to the multi-disc clutch 63. Thus, at idle and low speeds, only the inner propeller shaft 11 and propeller 16 will be driven.

When the engine speed reaches the pre-selected upper limit 132, the electronic control unit 117 will cause the solenoid 114 to operate valve 113 to a second position to deliver pressurized fluid to clutch assembly 63, as previously described, to provide driving engagement between the rotating housing 29 and the outer propeller shaft 37. Thus, both propellers 16 and 44 will operate in opposite directions and at the same speed. On slowing down from high speed, both propellers will continue to operate at reduced engine RPM down to a second, preselected intermediate limit 134, generally in the range of about 1,500 RPM. The electronic control unit 117 will then cause solenoid 114 to operate valve 113 to the first position to dump pressurized fluid from clutch assembly 63 to reservoir 76. This permits the springs 81 to move clutch 63 to the disengaged position to discontinue the drive of the outer propeller shaft 37 and propeller 44.

In reverse operation of the watercraft, clutch 24 is moved to the left, as shown in FIG. 3, through rotation of rod 36, causing clutch teeth 27 to engage the teeth 28 on housing 29. As housing 29 is splined to bevel gear 8, clutch 24 along with the inner propeller shaft 11 will rotate in the opposite direction to move the watercraft in reverse. At this time, the forward propeller 44 will free wheel. If the engine speed is increased above the pre-selected value of about 3,000 to 6,000 rpm while the clutch 24 is in the reverse position, the solenoid operated valve 113 will be moved to the second position, connecting valve outlet line 116 with clutch assembly 63, but as the pump shaft 95 is rotating in the opposite direction, the pump 92 will not operate to pressurize the hydraulic fluid, so that the multiple disc clutch 63 will not be engaged even at high speed.

If the clutch 24 is in the neutral position, and the engine is revved to high speed, above the pre-selected value, the electronic controller 117 will cause the solenoid operated valve 113 to be moved to the second position connecting valve outlet line 116 with clutch assembly 63, but in the neutral position of clutch 24, pump shaft 95 will not be rotated, so that the pump 92 will not be operated to pressurize the fluid. Thus, even if the engine speed is increased to above the pre-selected value, when clutch 24 is in neutral, clutch 63 will not be engaged and the outer propeller shaft 37 along with propeller 44 will not be operated.

With the construction of the invention, using sequential shifting, only a single propeller is operated at off plane boat speeds. This increases propeller slip and reduces boat speed when off-plane. Reduced boat speed facilitates docking. The second propeller is engaged when engine speed reaches a pre-selected elevated value to provide an improvement in acceleration. The side forces of the counter-rotating, cleaver-type propellers are balanced out, resulting in positive tracking, minimal steering torque as well as virtually eliminating chine walk.

As a further advantage, the multiple disc clutch assembly 63 is operated through pressurized hydraulic fluid which is pressurized by the pump 92 driven by the inner propeller shaft 11. The multiple disc clutch has the advantage of gradually taking up the load as it is engaged during high speed operation of the engine.

As the marine propeller unit can be a full surfacing type, in which the water line is slightly beneath the lower surface of the torpedo section 6 when the boat is on plane, torpedo grad is eliminated and a substantial improvement in boat speed and fuel economy is achieved.

While the above description has shown the invention as used with full surfacing propellers, it is contemplated that the invention can also be used with submerged propellers.

I claim:

1. A controller for a marine propulsion unit having a first propeller, a second propeller, and an engine, the controller comprising:

a converter for converting engine speed to an engine speed signal;

a comparator for comparing the engine speed signal to an upper limit;

a clutch driver coupled to the comparator for selectively engaging and disengaging the second propeller, the clutch driver engaging the second propeller when the engine speed signal exceeds the upper limit;

a modifying circuit coupled to the comparator, the modifying circuit reducing the upper limit to an intermediate limit after the engine speed signal exceeds the upper limit, such that the clutch driver will continue to engage the second propeller after the engine speed signal exceeds the upper limit as long as the engine speed signal continues to exceed the intermediate limit.

2. The controller of claim 1 wherein the engine speed signal, the upper limit, and the intermediate limit are all voltages.

3. A controller for a marine propulsion unit having a first propeller, a second propeller, and an engine, the controller comprising:

a converter for converting engine speed to an engine speed signal;

a comparator for comparing the engine speed signal to an upper limit;

a clutch driver coupled to the comparator for selectively engaging and disengaging the second propeller, the clutch driver engaging the second propeller when the engine speed signal exceeds the upper limit;

a second comparator for comparing the engine speed signal to a lower limit, the second comparator being in communication with the clutch driver such that the clutch driver engages the second propeller until the engine speed signal exceeds the lower limit.

4. A controller for a marine propulsion unit having a first propeller, a second propeller, and an engine, the controller comprising:

a converter for converting engine speed to an engine speed signal;

a comparator for comparing the engine speed signal to an upper limit;

a clutch driver coupled to the comparator for selectively engaging and disengaging the second propeller, the clutch driver engaging the second propeller when the engine speed signal exceeds the upper limit;

an offset circuit coupled between an engine throttle and the comparator, the offset circuit generating an offset signal in direct relation to the position of the engine throttle, the offset signal being added to the engine speed signal such that the clutch driver engages the second propeller when the combination of the offset signal and engine speed signal exceed the upper limit.

5. A controller for a marine propulsion unit having a first propeller, a second propeller, and an engine, the controller comprising:

a converter for converting a series of ignition pulses from the engine into an engine speed voltage, the engine speed voltage increasing in direct relation to an increase in engine speed;

a comparator coupled to the converter, the comparator comparing the engine speed voltage to an upper limit and outputting an engage signal when the engine speed voltage exceeds the upper limit and a disengage signal when the engine speed voltage is below the upper limit;

a clutch driver coupled to the comparator, the clutch driver engaging the second propeller upon receipt of the engage signal and disengaging the second propeller upon receipt of the disengage signal;

a modifying circuit coupled to the comparator, the modifying circuit reducing the upper limit to an intermediate limit upon receipt of the engage signal, such that the comparator will output an engage signal when the engine speed voltage exceeds the intermediate limit.

6. The controller of claims 5 further comprising an offset circuit coupled between an engine throttle and the comparator, the offset circuit generating an offset voltage in direct relation to the position of the engine throttle, the offset voltage being added to the engine speed voltage such that the comparator outputs the engage signal when the combination of the offset voltage and the engine speed voltage exceeds the upper limit.

7. The controller of claim 5 further comprising a bypass circuit coupled to the clutch driver, the bypass circuit causing the clutch driver to engage the second propeller when the engine speed voltage is below a lower limit.

8. The controller of claim 5 wherein the clutch driver includes a solenoid, the solenoid causing the second propeller to be engaged when the solenoid is de-energized and disengaged when the solenoid is energized.

9. A controller for a marine propulsion unit having a first and a second propeller and an engine, the controller comprising:

a trigger circuit generating a series of pulses directly related to the speed of the engine;

a frequency-to-voltage converter for converting the series of pulses into an engine speed voltage, the engine speed voltage increasing and decreasing with increased and decreasing engine speed, respectively;

a comparator coupled to the converter, the comparator comparing the engine speed voltage to an upper limit and outputting an engage signal when the engine speed voltage exceeds the upper limit and a disengage signal when the engine speed voltage is below the upper limit;

a clutch driver coupled to the comparator, the clutch driver engaging the second propeller upon receipt of the engage signal and disengaging the second propeller upon receipt of the disengage signal;

a modifying circuit coupled to the comparator, the modifying circuit reducing the upper limit to an intermediate limit upon receipt of the engage signal, such that the comparator will output an engage signal when the engine speed voltage exceeds the intermediate voltage limit; and a bypass circuit coupled to the converter, the bypass circuit comparing the engine speed voltage to a lower limit, the bypass circuit causing the clutch driver to engage the second propeller until the engine speed voltage exceeds the lower limit.

10. The controller of claim 9 further comprising an offset circuit coupled between an engine throttle and the comparator, the offset circuit generating an offset voltage in direct relation to the position of the engine throttle, the offset voltage being added to the engine speed voltage such that the comparator outputs the engage signal when the combination of the offset voltage and the engine speed voltage exceeds the upper limit.

11. The controller of claim 9, wherein the clutch driver includes a solenoid, the solenoid causing the second propeller to be engaged when the solenoid is deenergized and causing the second propeller to be disengaged when the solenoid is energized.

12. A method of controlling the operation of a marine propulsion unit having a first and a second propeller coupled to an engine through a clutch assembly, the method comprising the steps of:

converting the engine speed to an engine speed signal, the engine speed signal being directly related to the engine speed and increasing in value as the engine speed increases;

comparing the engine speed signal to an upper limit;

activating the clutch assembly to engage the second propeller when the engine speed signal exceeds the upper limit;

reducing the upper limit to an intermediate limit after the second propeller has been engaged by the clutch assembly;

comparing the engine speed signal to the intermediate limit; and deactivating the clutch assembly to disengage the second propeller when the engine speed signal falls below the intermediate limit.

13. The method of claim 12 further comprising the step of:

generating an offset signal in direct relation to the position of an engine throttle;

adding the offset signal to the engine speed signal; and comparing the combination of the offset signal and the engine speed signal to the upper limit such that the second propeller will be engaged when the combination exceeds the upper limit.

14. The method of claim 12 further comprising the step of:

comparing the engine speed signal to a lower limit; and activating the clutch assembly to engage the second propeller when the engine speed signal is below the lower limit.

15. The method of claim 14 herein the lower limit corresponds to an engine speed below idle speed.

16. The method of claim 12 wherein the step of activating the clutch assembly includes de-energizing a solenoid.

17. The method of claim 16 wherein the step of deactivating the clutch assembly includes energizing a solenoid.

18. The method of claim 12 wherein the step of reducing the upper limit to the intermediate limit includes switching in a resistor.

* * * * *